US012049373B2

(12) United States Patent
Okada

(10) Patent No.: US 12,049,373 B2
(45) Date of Patent: Jul. 30, 2024

(54) SHEET FEEDING DEVICE AND IMAGE FORMING APPARATUS INCORPORATING THE SHEET FEEDING DEVICE

(71) Applicant: Katsumi Okada, Kanagawa (JP)

(72) Inventor: Katsumi Okada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 260 days.

(21) Appl. No.: 17/769,852

(22) PCT Filed: Dec. 23, 2020

(86) PCT No.: PCT/IB2020/062371

§ 371 (c)(1),
(2) Date: Apr. 18, 2022

(87) PCT Pub. No.: WO2021/148870

PCT Pub. Date: Jul. 29, 2021

(65) Prior Publication Data

US 2022/0363504 A1 Nov. 17, 2022

(30) Foreign Application Priority Data

Jan. 21, 2020 (JP) ..... 2020-007309

(51) Int. Cl.
*B65H 19/10* (2006.01)
*B65H 23/188* (2006.01)

(52) U.S. Cl.
CPC ..... *B65H 19/105* (2013.01); *B65H 23/1882* (2013.01); *B65H 2403/942* (2013.01); *B65H 2701/1311* (2013.01)

(58) Field of Classification Search
CPC ..... B65H 19/105; B65H 2553/414
See application file for complete search history.

(56) References Cited

U.S. PATENT DOCUMENTS 4,809,188 A * 2/1989 Willits ..... B65H 23/1882 250/548
5,547,183 A 8/1996 Tamura
5,947,408 A * 9/1999 Miyake ..... B65H 19/105 242/562

(Continued)

FOREIGN PATENT DOCUMENTS

CN 1480336 A 3/2004
CN 1935612 A 3/2007

(Continued)

OTHER PUBLICATIONS

International Search Report issued on Mar. 25, 2021 in PCT/IB2020/062371 filed on Dec. 23, 2020.

(Continued)

*Primary Examiner* — William A. Rivera
(74) *Attorney, Agent, or Firm* — Harness, Dickey & Pierce, P.L.C.

(57) ABSTRACT

A sheet feeding device includes a sensor, a roller, and a support on which the sensor and the roller are disposed. The support supports the sensor and the roller so that the sensor and the roller contact a surface of the sheet roll. The sensor and the roller face toward an axial center of the sheet roll. The roller is spaced apart from the sensor in a circumferential direction of the sheet roll. The sensor has a detection accuracy capable of detecting a step at a leading end of the sheet roll.

9 Claims, 13 Drawing Sheets

(56) References Cited

U.S. PATENT DOCUMENTS

| | | | | |
|---|---|---|---|---|
| 9,457,596 | B2 * | 10/2016 | Ogawa | B41J 11/0075 |
| 10,155,402 | B2 | 12/2018 | Yatsunami et al. | |
| 10,703,117 | B2 | 7/2020 | Eiyama et al. | |
| 2004/0028450 | A1 | 2/2004 | Jung | |
| 2006/0001729 | A1 * | 1/2006 | Inana | B41J 15/042 347/218 |
| 2006/0151118 | A1 | 7/2006 | Murata et al. | |
| 2007/0063086 | A1 | 3/2007 | Itoh et al. | |
| 2008/0179444 | A1 * | 7/2008 | Takeuchi | B41J 2/32 242/564.1 |
| 2011/0109037 | A1 | 5/2011 | Kunioka | |
| 2012/0056932 | A1 | 3/2012 | Matsubara et al. | |
| 2012/0069114 | A1 * | 3/2012 | Kaneko | B41J 13/223 271/18.1 |
| 2012/0133707 | A1 | 5/2012 | Kikkawa et al. | |
| 2012/0280447 | A1 * | 11/2012 | Kayanuma | B65H 9/08 271/272 |
| 2013/0221054 | A1 | 8/2013 | Ogawa | |
| 2014/0151491 | A1 * | 6/2014 | Mizutani | B65H 26/063 242/563 |
| 2014/0166802 | A1 | 6/2014 | Yamaya | |
| 2015/0328906 | A1 * | 11/2015 | Sumioka | B65H 16/02 242/564.5 |
| 2016/0090256 | A1 | 3/2016 | Nakayama et al. | |
| 2017/0282606 | A1 | 10/2017 | Yatsunami et al. | |
| 2018/0257408 | A1 * | 9/2018 | Eiyama | B65H 16/021 |

FOREIGN PATENT DOCUMENTS

| | | | |
|---|---|---|---|
| CN | 102126628 | A | 7/2011 |
| CN | 103287125 | A | 9/2013 |
| CN | 103862886 | A | 6/2014 |
| CN | 107265151 | A | 10/2017 |
| CN | 108674039 | A | 10/2018 |
| DE | 4229010 | A1 | 3/1993 |
| EP | 0395003 | A2 | 10/1990 |
| JP | 2000-255832 | A | 9/2000 |
| JP | 2002-179308 | A | 6/2002 |
| JP | 2003-251875 | A | 9/2003 |
| JP | 2006-305986 | A | 11/2006 |
| JP | 2007-185774 | A | 7/2007 |
| JP | 2016-069184 | A | 5/2016 |
| JP | 2018-150106 | | 9/2018 |
| JP | 2018-150107 | | 9/2018 |
| JP | 2018-150112 | A | 9/2018 |

OTHER PUBLICATIONS

Office Action dated Oct. 24, 2023 issued in corresponding Japanese Patent Application No. 2020-007309.

Office Action issued Sep. 13, 2023 in Chinese Application No. 202080091431.7.

* cited by examiner

SIGNAL WAVEFORM OF LEADING END OF SHEET ROLL

SIGNAL WAVEFORM OF PROJECTING STREAK

SHEET FEEDING DEVICE AND IMAGE FORMING APPARATUS INCORPORATING THE SHEET FEEDING DEVICE

CROSS-REFERENCE TO RELATED APPLICATIONS

This application is a national phase under 35 U.S.C. § 371 of PCT International Application No. PCT/IB2020/062371 which has an International filing date of Dec. 23, 2020, which claims priority to Japanese Application No. 2020-007309, filed Jan. 21, 2020, the entire contents of each of which are hereby incorporated by reference.

TECHNICAL FIELD

Embodiments of the present disclosure generally relate to a sheet feeding device and an image forming apparatus incorporating the sheet feeding device.

BACKGROUND ART

Various image forming apparatuses handling a sheet roll are known to include a sheet feeding mechanism that performs a sheet feeding operation, after a user manually has inserted the leading end of a sheet roll into a sheet feeder and after the image forming apparatus has detected the leading end of the sheet roll.

When a known image forming apparatus performs a sheet feeding operation, a user takes time to insert the leading end of a sheet roll manually into the sheet feeder. When feeding the sheet roll, the leading end of the sheet roll that was inserted obliquely into the sheet feeder causes skew of the orientation of the sheet roll, resulting in making a service call.

Further, for example, PTL (JP-2018-150107-A) discloses a technique that an image forming apparatus includes a sensor that changes the output value according to the distance to the sheet. The image forming apparatus causes a sheet roll to rotate in a sheet winding direction to separate a sheet from the sheet roll, so that the sensor then detects the leading end of the sheet stripped off or separated from the sheet roll. However, since the separation state of the sheet changes due to the thickness, stiffness, and the curling state of the sheet, the inconvenience that the output value of the sensor becomes unstable is not eliminated.

SUMMARY OF INVENTION

Problems to be Solved

An object of the present disclosure is to a sheet feeding device that reliably detects and conveys the leading end of a sheet of a sheet roll to a sheet feeder, and an image forming apparatus incorporating the sheet feeding device.

Solution to Problem

According to an aspect of the present disclosure, a sheet feeding device includes a sensor, a roller, and a support on which the sensor and the roller are disposed. The support supports the sensor and the roller so that the sensor and the roller contact a surface of the sheet roll. The sensor and the roller face toward an axial center of the sheet roll. The roller is spaced apart from the sensor in a circumferential direction of the sheet roll. The sensor has a detection accuracy capable of detecting a step at a leading end of the sheet roll.

Advantageous Effects of Invention

According to the present disclosure, the leading end of a sheet of a sheet roll is detected reliably and is conveyed to a sheet feeder.

BRIEF DESCRIPTION OF DRAWINGS

The accompanying drawings are intended to depict example embodiments of the present disclosure and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
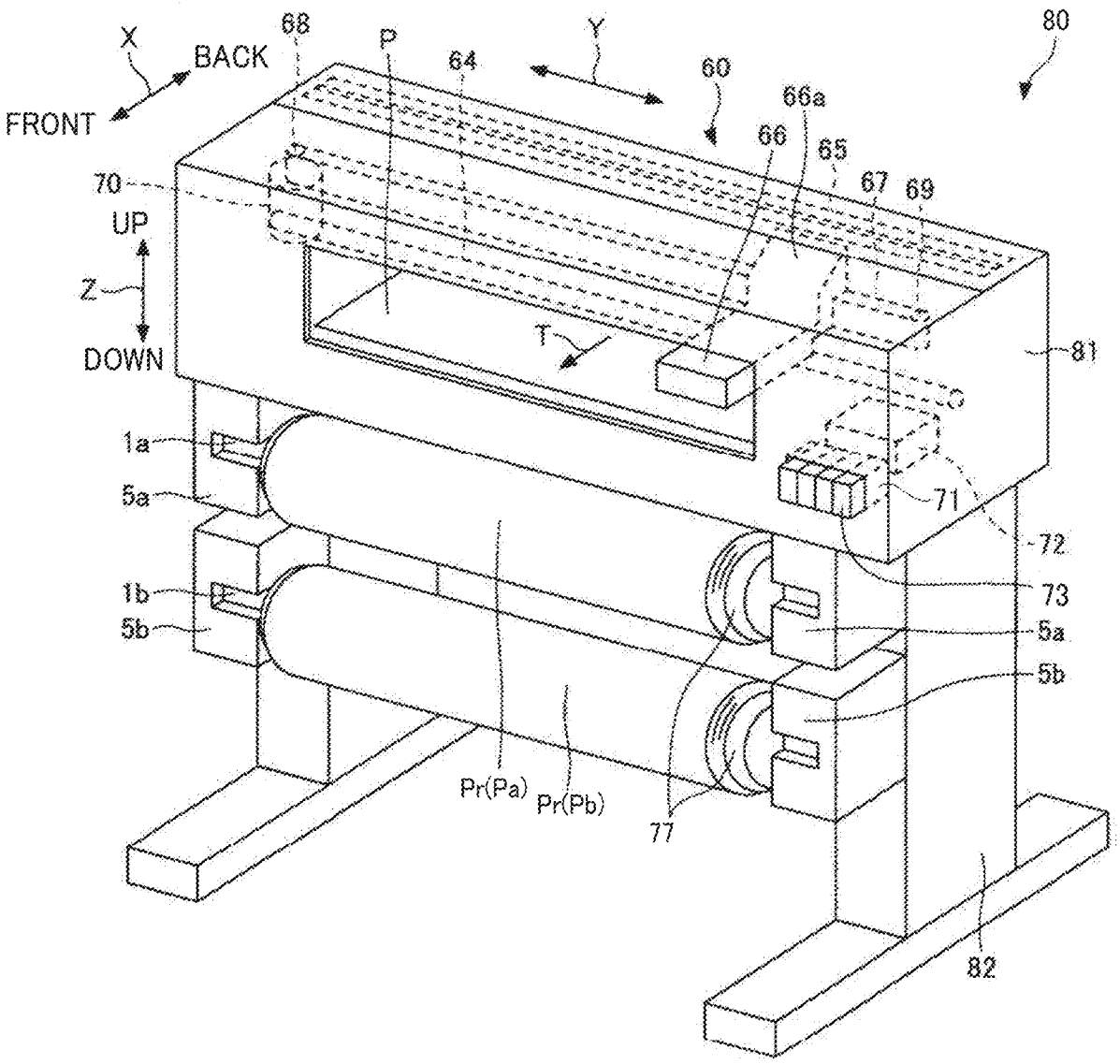
FIG. 1 is a diagram illustrating an example of a schematic configuration of an image forming apparatus according to an embodiment of the present disclosure.

Now, a description is given of a sheet feeding device according to the present disclosure and an image forming apparatus according to the present disclosure, with reference to the drawings. Note that the following embodiments are not limiting the present disclosure and any deletion, addition, modification, change, etc. can be made within a scope in which person skilled in the art can conceive including other embodiments, and any of which is included within the scope of the present disclosure as long as the effect and feature of the present disclosure are demonstrated. Further, in the drawings, the same reference numerals are given to same components and corresponding parts having the same configurations or functions, and redundant description thereof will be omitted.

A sheet feeding device according to an embodiment of the present disclosure feeds a sheet from a sheet roll. The sheet roll is a recording medium around which a long sheet (also referred to as a "sheet") is wound in a roll shape.

Figure 2:
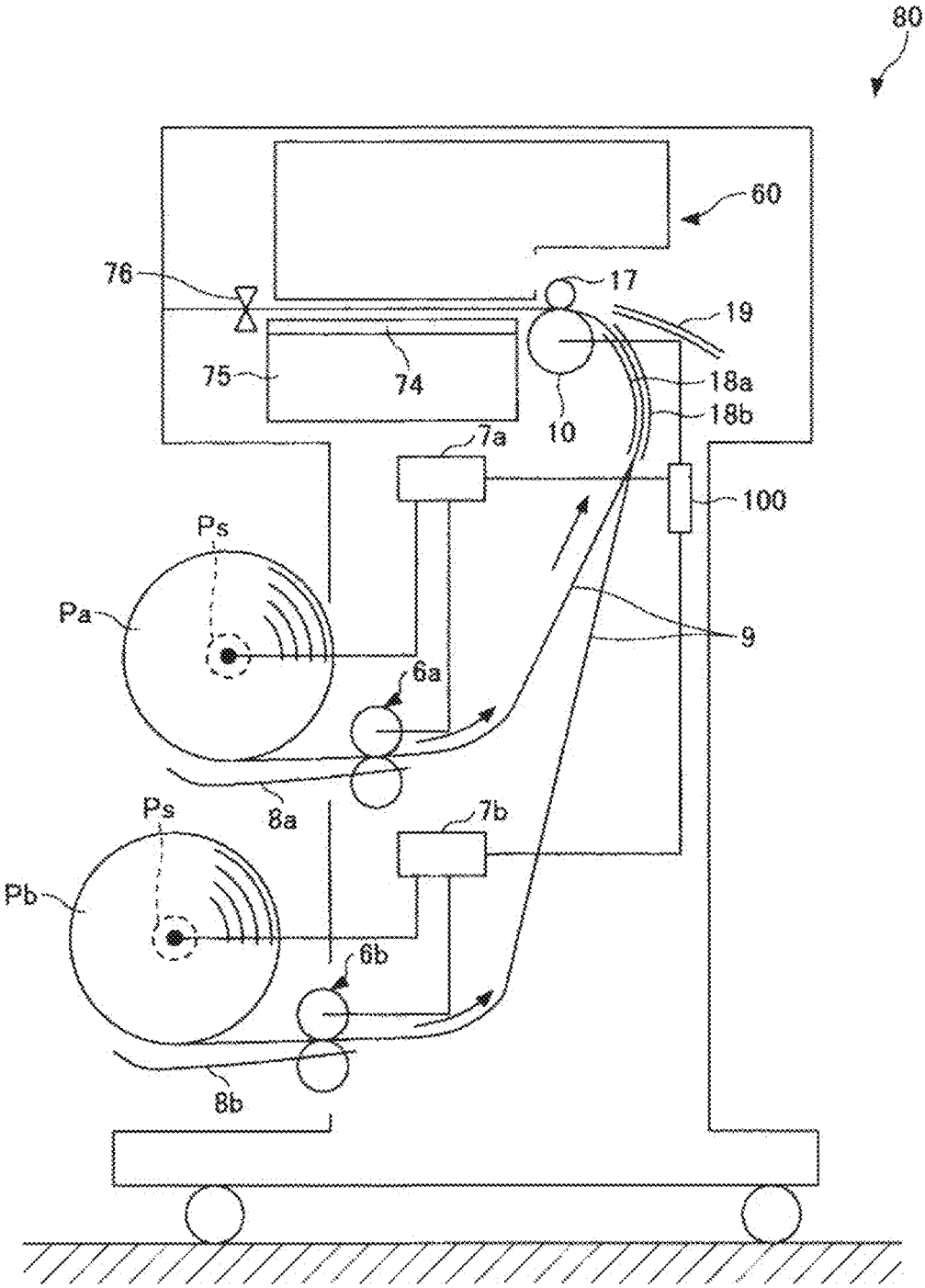
FIG. 2 is a schematic cross-sectional view illustrating an example of the configuration of the image forming apparatus according to an embodiment of the present disclosure.

A description is given of an example of the configuration of an image forming apparatus to which a sheet feeding device according to an embodiment of the present disclosure is applied, with reference to FIGS. 1 and 2.

The image forming apparatus that is an aspect of an embodiment of the present disclosure is an inkjet printer that prints on a recording medium by discharging ink droplets corresponding to the image data but the configuration of the image forming apparatus is not limited to the inkjet printer. For example, the present disclosure may be applied to an image forming apparatus employing an electrophotographic method to convey and print a recording medium such as a copier and a printing machine.

FIG. 1 is a perspective view illustrating an example of the schematic configuration of an image forming apparatus 80 according to an embodiment of the present disclosure. FIG. 2 is a cross-sectional side view illustrating the configuration of the image forming apparatus of FIG. 1. A description is given of the overall configuration and operations of the image forming apparatus 80 according to an embodiment of the present disclosure, with reference to FIGS. 1 and 2. In FIG. 1, arrow X indicates the depth direction (front-back direction) of the image forming apparatus 80 (hereinafter, X direction), arrow Y indicates the width direction (main scanning direction) of the image forming apparatus 80 (hereinafter, Y direction), and arrow Z indicates the vertical direction (up-down direction) of the image forming apparatus 80 (hereinafter, Z direction).

In FIG. 1, the image forming apparatus 80 is a serial-type image forming apparatus of a liquid discharge method (ink discharge method) and has a housing 81 and a housing frame 82. The housing 81 is mounted on the housing frame 82. In the image forming apparatus 80, a main guide rod 64 and a sub guide rod 65 are bridged over in the housing 81, in the main scanning direction corresponding to the Y direction indicated by bidirectional arrow in FIG. 1. The main guide rod 64 movably supports a carriage 66 that includes a connection piece 66*a* that engages with the sub guide rod 65 to stabilize the posture of the carriage 66.

The image forming apparatus 80 includes a timing belt 67 along the main guide rod 64. The timing belt 67 is an endless belt that is stretched between a drive pulley 68 and a driven pulley 69. The drive pulley 68 is driven and rotated by a main scanning motor 70. The driven pulley 69 is disposed in a state in which the driven pulley 69 applies a predetermined stretching amount to stretch the timing belt 67 taut. As the main scanning motor 70 drives to rotate the drive pulley 68, the drive pulley 68 rotates the timing belt 67 in the main scanning direction according to the rotational direction of the drive pulley 68.

The carriage 66 is coupled to the timing belt 67. As the drive pulley 68 rotates to move the timing belt 67 in the main scanning direction, the carriage 66 reciprocally moves in the main scanning direction along the main guide rod 64.

The image forming apparatus 80 further includes a cartridge holder 71 and a maintenance unit 72. The cartridge holder 71 and the maintenance unit 72 are detachably attached (stored) to one end of the housing 81 in the main scanning direction (Y direction). The cartridge holder 71 holds cartridges 73 that contain inks of respective colors, which are yellow (Y), magenta (M), cyan (C), and black (K). Each cartridge 73 is replaceably stored in the cartridge holder 71. The carriage 66 has recording heads of respective colors, which are yellow (Y), magenta (M), cyan (C), and black (K). Each cartridge 73 of the cartridge holder 71 is coupled with the recording head of the corresponding color, via a pipe. According to this configuration, ink is supplied from the cartridges 73 of the cartridge holder 71 to the recording heads of the respective colors via the pipe.

In the image forming apparatus 80, while the carriage 66 moves in the main scanning direction, the recording heads provided in the carriage 66 discharge ink droplets of respective colors onto the sheet P that is conveyed intermittently on a platen (plate) 74 (see FIG. 2) in a sub-scanning direction (X direction indicated by arrow in FIG. 1) orthogonal to the main scanning direction. By so doing, the image forming apparatus 80 records an image on a sheet P.

The sheet P is not limited to a paper sheet but may be various types of sheets such as a roll-type film. In order to clarify the description, hereinafter, a sheet during sheet conveyance is referred to as the sheet P, the sheet P in a roll shape is referred to as a sheet roll Pr (Pa, Pb), and a core tube (core portion) of the sheet roll Pr is referred to as a core tube Ps.

As illustrated in FIG. 2, the image forming apparatus 80 further includes a chamber 75 provided with a fan. The chamber 75 is disposed below the platen 74. As the fan of the chamber 75 is driven, the sheet P is conveyed on the platen 74 while the sheet P is closely contacting the platen 74.

The image forming apparatus 80 intermittently conveys the sheet P in the sub-scanning direction. Then, while the conveyance of the sheet P in the sub-scanning direction is stopped, as the carriage 66 moves in the main scanning direction, ink droplets are discharged from the nozzle row of each recording head provided on the carriage 66 onto the sheet P on platen 74. By so doing, an image is formed (recorded) on the sheet P in a roll shape.

The maintenance unit 72 performs maintenance of the recording head, such as cleaning of the ink discharging face of the recording head, capping the recording head, and discharging (removing) ink that is not used. By so doing, the maintenance unit 72 discharges (removes) unnecessary ink from the recording head and maintains the reliability of the recording head.

The image forming apparatus 80 further includes an encoder sheet over at least the moving range of the carriage 66 in parallel to the timing belt 67 and the main guide rod 64. The carriage 66 includes an encoder sensor that reads the encoder sheet. The image forming apparatus 80 controls the driving of the main scanning motor 70 based on the sensing result of the encoder sensor obtained by reading the encoder sheet, so as to control the movement of the carriage 66 in the main scanning direction.

Further, a reflective sensor (e.g., an encoder sensor and a sheet leading end detection sensor) mounted on the carriage 66 detects both lateral side ends of the sheet P conveyed to an image forming device 60. At that time, the size of the sheet P is detected according to the positions of the lateral side ends of the sheet P in the main scanning direction that is read by the sheet leading end detection sensor.

As illustrated in FIGS. 1 and 2, the image forming apparatus 80 further includes two spool bearing bases 5*a* and 5*b* on the housing frame 82 supported by the housing 81 of the image forming apparatus 80. The spool bearing bases 5*a* and 5*b* are disposed vertically, that is, in the vertical direction (Z direction) of FIGS. 1 and 2.

As illustrated in FIGS. 1 and 2, the sheet rolls Pr are set on the spool bearing bases 5*a* and 5*b*. To be more specific, as illustrated in FIG. 1, the sheet roll Pa is set on the spool bearing base 5*a* and the sheet roller Pb is set on the spool bearing base 5*b*. As the sheet P (in a roll shape) is drawn from the leading end of the sheet rolls Pa set on the spool bearing base 5*a* or the leading end of the sheet roller Pb set on the spool bearing base 5*b*, the sheet P is conveyed by pairs of sheet conveying rollers 6*a* and 6*b*, a registration roller 10, and a registration pressure roller 17 in a corresponding one of sheet conveyance passages 9, as indicated by arrows in FIG. 2.

A controller 100 controls drive devices 7*a* and 7*b* to rotate the pairs of sheet conveying rollers 6*a* and 6*b*, the registration roller 10, and the registration pressure roller 17.

Sheet roll receiving bases 8*a* and 8*b* are disposed below the sheet roll Pr (i.e., the sheet rolls Pa and Pb) to prevent the sheet roll Pr from falling from the spool bearing bases 5*a* and 5*b*.

The sheet P passes through the corresponding one of the sheet conveyance passages 9 that are supported and partly defined by respective medium conveyance guides 18*a* and 18*b*. Then, the sheet P is conveyed to the platen 74 in the image forming device 60. Note that, in a case in which a duplex printing is performed to form images on both faces (both sides) of the sheet P, the sheet P is reversed in a sheet reverse unit 19 to reverse the front face to the back face of the sheet P.

In the image forming device 60, the recording heads that contain respective colors of inks discharge the ink droplets (liquid) of respective colors onto the sheet P according to image data, so that the image forming device 60 forms an image on the sheet P. A cutter 76 is disposed at the sheet ejection portion in the normal direction T of the sheet conveyance direction (positive X direction in FIG. 1) of the sheet P on which an image is formed. The cutter 76 extends in the sub-scanning direction (i.e., sheet width direction and Y direction) to cut the continuous sheet P to the predetermined length of the sheet P.

In order to align the leading end of the sheet P that is a continuous sheet fed from the sheet roll Pr, the cutter 76 is fixed to a wire or a timing belt wound around or stretched between a plurality of pulleys. One of the plurality of pulleys is coupled with the drive motor. As the drive motor drives and conveys the continuous sheet P in the main scanning direction (i.e., Y direction), the sheet P is cut to the predetermined length. The cut sheet P is ejected to the sheet ejection portion.

Note that FIGS. 1 and 2 depict the configuration example of the image forming apparatus having the configuration in which the sheet rolls Pa and Pb are set to the two spool bearing bases 5*a* and 5*b*. However, the configuration of the image forming apparatus to which the present disclosure is applicable is not limited to the above-described configuration. For example, the image forming apparatus may be provided with one spool bearing base.

Further, in the above description, the parts and components related to the two sheet rolls Pa and Pb are distinguished by describing with the suffixes "a" and "b" (for example, the spool bearing bases 5*a* and 5*b*). Hereinafter, the suffixes "a" and "b" are omitted, except when the parts and components may need to be distinguished.

Here, a description is given of a comparative method of setting a sheet roll.

FIGS. 3A, 3B, 3C, 3D, and 3E are diagrams each for explaining a comparative method of setting a sheet roll.

Figure 3A:
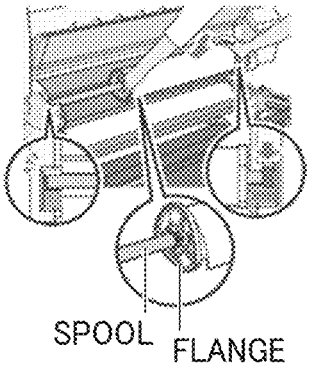
FIGS. 3A, 3B, 3C, 3D, and 3E are diagrams each for explaining a comparative method of setting a sheet roll.
Figure 3B:
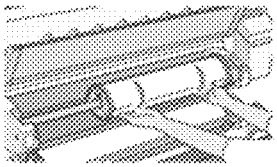

A flange (flange member) 77 is set at both ends in the width direction of the sheet roll Pr, so that each spool 1 (spools 1*a* and 1*b*) is set to the flange 77. A user sets the sheet roll to which the spool 1 (or spools 1*a* and 1*b*) is set, to a sheet feeder receiver (spool bearing base) of the image forming apparatus (see FIG. 3A). After finding the leading end of the sheet roll, the user holds the sheet roll while keeping (without losing) the leading end of the sheet roll by both hands, as illustrated in FIG. 3B. Then, the user rotates the sheet roll to cause the leading end of the sheet to come to face the user (in other words, to the front side of the image forming apparatus 80. Then, the user places the leading end of the sheet at the position between the guide plates disposed behind the sheet roll and inserts the leading end of the sheet while rotating the sheet roll (see FIG. 3C). The guide plates include an upper guide plate and a lower guide plate, each made of a transparent material, so that the sheet can be seen through the guide plates. The user rotates the sheet roll toward the far side of the image forming apparatus 80 to cause the leading end of the sheet roll to come to the upper part of the lower guide plate. As the user inserts the sheet roll into the far side behind the lower guide plate, the sheet roll is fixed inside the housing of the image forming apparatus and drawn to the inside of the image forming apparatus.

Figure 3C:
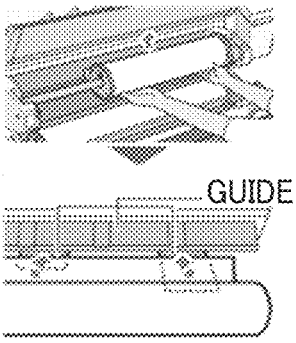

As illustrated in FIG. 3C, since the guide plate into which the leading end of the sheet is inserted is located behind the sheet roll, the guide plate is hidden by the sheet roll and is difficult to see from the front side of the image forming apparatus. Further, since the guide plates are made of a transparent material, even when the user thinks the sheet is inserted between the two guide plates, the sheet may be actually placed on the top of the upper guide plate, which may cause the user to place the sheet on the correct position again. Further, when the guide plates are not made of a transparent material, it is difficult to confirm whether the sheet is inserted between the two guide plates.

In addition, the leading end of the sheet roll needs to be inserted evenly as possible, and therefore the user has to be careful. Furthermore, in a case in which the leading end of the sheet is not inserted evenly, the sheet in this uneven state may be fed obliquely, resulting in skew. Therefore, the operation may be performed again to prevent occurrence of a paper jam.

Figure 3D:
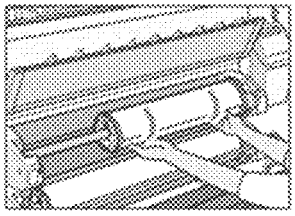
Figure 3E:
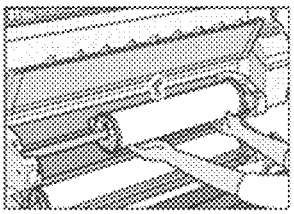

Further, as illustrated in FIGS. 3D and 3E, in the image forming apparatus in which the sheet rolls are disposed vertically in two steps, there may be a case that a sheet roll is to be set on the lower step while another sheet roll has already been set on the upper step. In such a case, even when the leading end of the sheet roll is to be inserted between the guide plates, due to the sheet roll that has already been set on the upper step, it is further difficult to see the guide plates, and therefore may increase the difficulty in setting the sheet roll and the chances of the oblique insertion of the sheet.

In order to address this inconvenience, the sheet feeding device according to an embodiment of the present disclosure has a configuration in which the leading end of the sheet of the sheet roll is detected. By detecting the difference of step (height) of the leading end of the sheet, the leading end of the sheet P is detected, and therefore the sheet is fed to the sheet feeder (sheet feeding portion). The sheet feeder is a unit to supply the sheet of the sheet roll to a supplying target.

For example, the sheet feeder is the pair of sheet conveying rollers 6 or the sheet conveyance passage 9 illustrated in FIG. 2.

Figure 4:
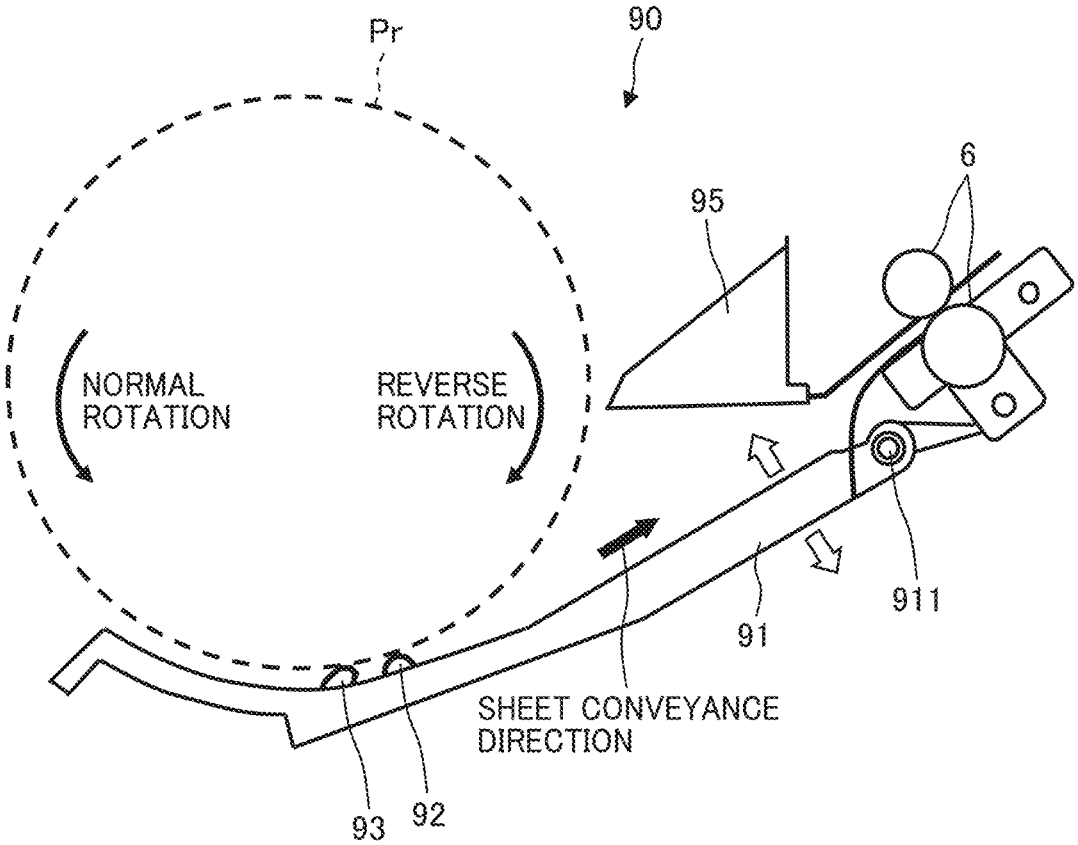
FIG. 4 is a side view illustrating a main part of an example of the configuration of a sheet feeding device according to an embodiment of the present disclosure, included in the image forming apparatus of FIG. 1.

FIG. 4 is a side view illustrating the main part of a configuration example of a sheet feeding device according to an embodiment of the present disclosure, included in the image forming apparatus 80 of FIG. 1.

The sheet feeding device 90 includes at least an arm 91, a roller 92, a sensor 93, and the pair of sheet conveying rollers 6 that functions as a sheet conveyor. It is more preferable that the sheet feeding device 90 further includes an entrance guide plate 95.

In FIG. 4, the broken line indicates the position of the sheet roll Pr when the user sets the sheet roll Pr in the sheet feeding device 90. The sheet roll Pr is rotatably held by a module component, based on the center (shaft) of the sheet roll Pr.

The arm (guide plate) 91 functions as a support of the sheet roll Pr and is rotatable about the rotation center 911. The arm 91 is pressed against one end of the axis of the rotation center 911 toward the sheet roll Pr by a biasing member such as a spring. Accordingly, the arm 91 contacts the outer diameter of the sheet roll Pr even when the diameter of the sheet roll Pr changes. The white arrows indicate the moving direction of the arm 91, to be more specific, the rotational direction of the arm 91.

Further, the arm 91 has a roller 92 and a sensor 93 on the opposite end of the axis of the rotation center 911. Since the arm 91 is pressed toward the sheet roll Pr, the roller 92 and the sensor 93 are supported to come into contact with the surface of the sheet roll Pr.

The arm 91 acts as a guide plate to guide the sheet P stripped off or separated from the sheet roll Pr in the sheet conveyance direction. The arm 91 may have a shape along the outer diameter of the sheet roll Pr (e.g., arc shape) at the portion (end portion) to which the sheet roll Pr is set. According to the shape of the arm 91, when the sheet roll Pr is set, the sheet roll Pr is reliably held (without falling). The arm 91 also functions as the sheet roll receiving table 8 illustrated in FIG. 2.

The arm 91 as a support also functions as a guide plate to guide the sheet roll Pr, so that the number of parts and components is reduced, thereby restraining the cost.

The roller 92 and the sensor 93 are disposed facing substantially the center of the sheet roll Pr, in other words, toward the axial center of the sheet roll Pr, regardless of the diameter of the sheet roll Pr.

The roller 92 is spaced apart from the sensor 93 in the circumferential direction of the sheet roll Pr, so that the roller 92 and the sensor 93 are disposed at offset positions (different positions) from each other in the circumferential direction of the sheet roll Pr.

The sensor 93 has the detection accuracy capable of detecting a step (thickness) at the leading end of the sheet roll Pr.

The entrance guide plate 95 guides the sheet P that has been stripped off or separated from the sheet roll Pr, in the sheet conveyance direction. In the configuration example of FIG. 4, when the sheet P is fed in the sheet feeding operation (with the normal rotation of the sheet roll Pr), the arm 91 that functions as a guide plate guides the sheet P on the upstream side in the sheet conveyance direction and the entrance guide plate 95 guides the sheet P on the downstream side in the sheet conveyance direction. In other words, the arm 91 is disposed upstream from the entrance guide plate 95 in the rotational direction of the sheet roll in the sheet feeding operation.

Next, a description is given of the control of the function of the sheet feeding device 90.

Figure 5:
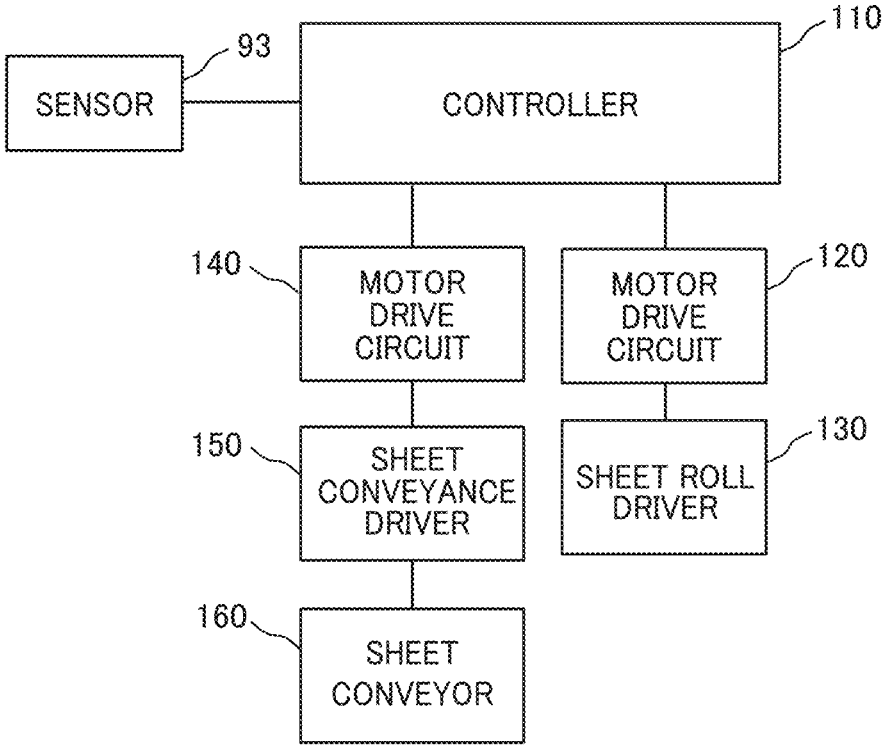
FIG. 5 is a functional block diagram illustrating an example of the functions of the sheet feeding device according to an embodiment of the present disclosure.

FIG. 5 is a functional block diagram illustrating an example of the functions of the sheet feeding device according to an embodiment of the present disclosure.

A controller 110 executes the overall control of the sheet feeding device 90. Note that FIG. 5 illustrates the functional block in which the controller 110 controls the sensor 93 and motor drive circuits 120 and 140 and the other function blocks are omitted. The functions of the controller 110 may be executed by the controller 100 (see FIG. 2) that controls the overall control of the image forming apparatus 80.

The controller 110 includes, for example, a central processing unit (CPU), a random access memory (RAM), and a read only memory (ROM).

The CPU executes various programs and controls the entire image forming apparatus 80 based on arithmetic processing and control programs.

The RAM is a volatile storage medium to read and write information at high speed and functions as a work area when the CPU executes a program.

The ROM is a read-only nonvolatile storage medium in which various programs and control programs are stored.

The motor drive circuit 120 drives the motor under the control by the controller 110 to drive a sheet roll driver 130.

The sheet roll driver 130 rotates the sheet roll Pr in the normal direction or the reverse direction. The sheet roll driver 130 includes a sheet roll rotation motor, for example.

The motor drive circuit 140 drives the motor under the control by the controller 110 to drive a sheet conveyance driver 150.

The sheet conveyance driver 150 drives a sheet conveyor 160.

The sheet conveyor 160 is a sheet conveyor that conveys the sheet P, for example, the pair of sheet conveying rollers 6.

Figure 6:
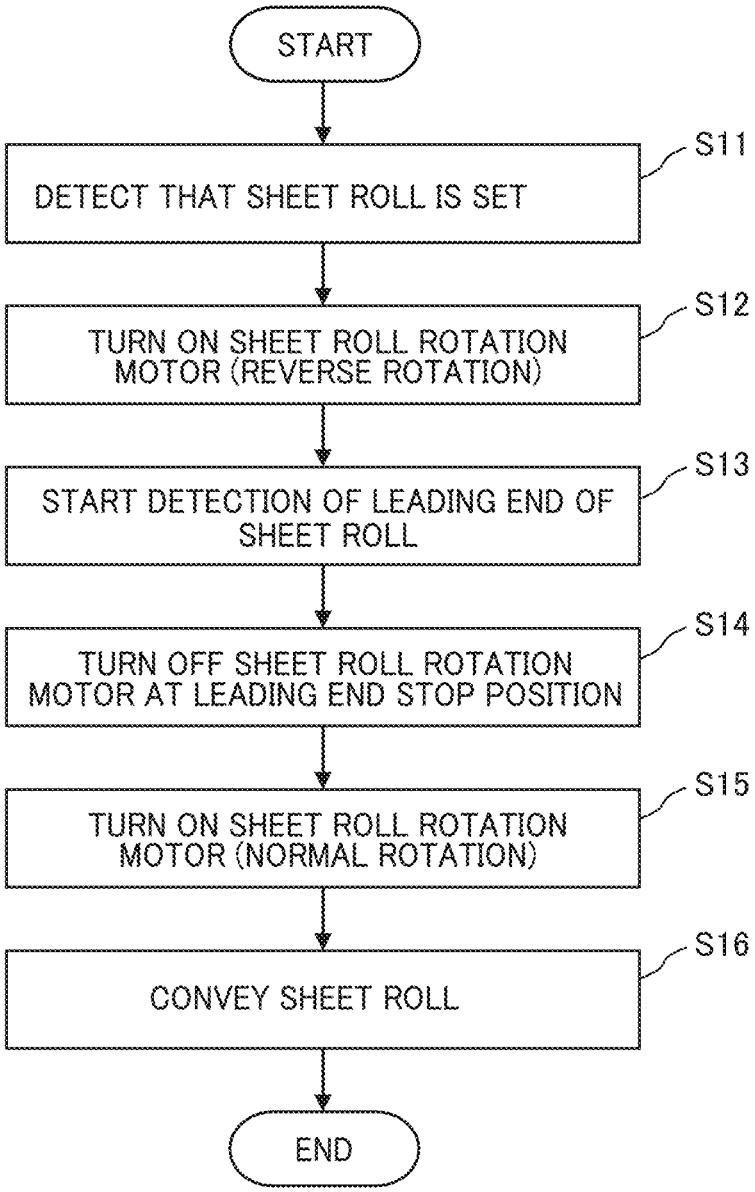
FIG. 6 is a flowchart illustrating an example of an operation of setting a sheet roll in the sheet feeding device according to an embodiment of the present disclosure.

Next, a description is given of the operation example to set the sheet roll Pr. FIG. 6 is a flowchart illustrating an operation example to set the sheet roll in the sheet feeding device according to an embodiment of the present disclosure.

When the controller 110 detects that the sheet roll Pr is set to the sheet feeding device 90, for example, based on the detection result of the sensor 93 (step S11), the controller 110 controls the motor drive circuit 120 to cause the sheet roll driver 130 to rotate the sheet roll Pr in the reverse direction. The controller 110 turns on the sheet roll rotation motor (sheet roll driver 130) to rotate the sheet roll Pr in a direction to wind the sheet in the sheet reverse operation, in other words, to perform a reverse rotation (step S12). Then, the sensor 93 starts to perform detection of the leading end of the sheet roll Pr (step S13). As the sensor 93 detects the leading end of the sheet roll Pr, the controller 110 turns off the motor drive circuit 120 to stop the sheet roll rotation motor at the sheet leading end stop position (step S14), and then turns on the sheet roll rotation motor to rotate the sheet roll Pr in the normal direction (normal rotation) in the sheet conveyance direction to feed the leading end of the sheet roll Pr in the sheet conveyance direction (step S15). The motor drive circuit 140 rotates the sheet conveyor 160 to convey the leading end of the sheet P into the inside of the motor drive circuit 140 (step S16).

Next, a description is given of the configuration example of the arm 91 as a support and an operation example of detection of the leading end of the sheet roll.

Figure 7A:
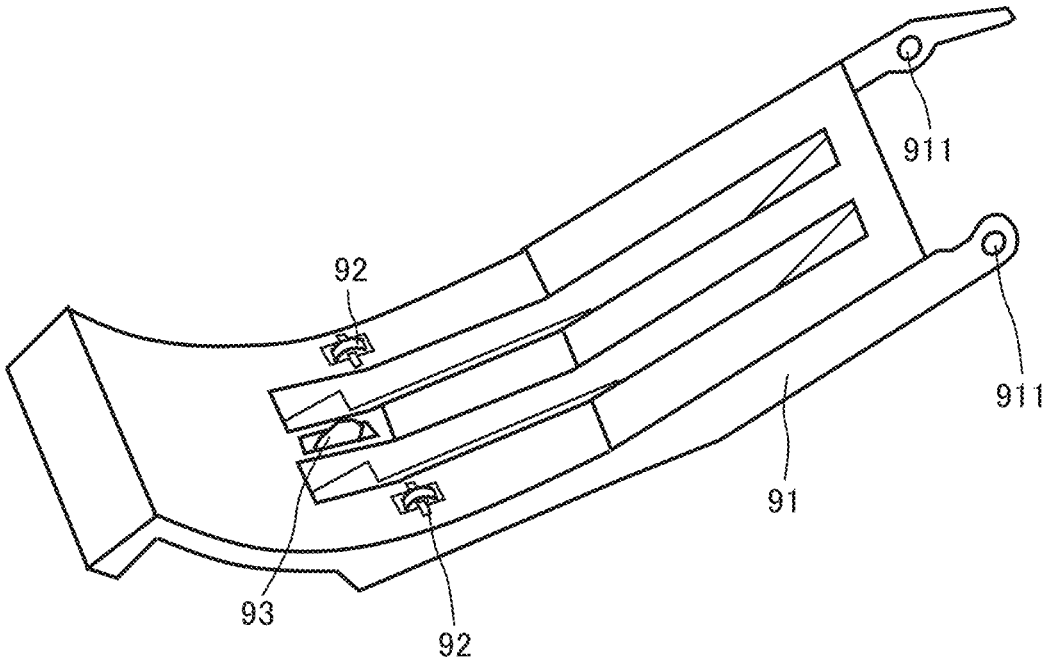
FIGS. 7A, 7B, and 7C are diagrams each illustrating a configuration example of an arm according to an embodiment of the present disclosure.
Figure 7B:
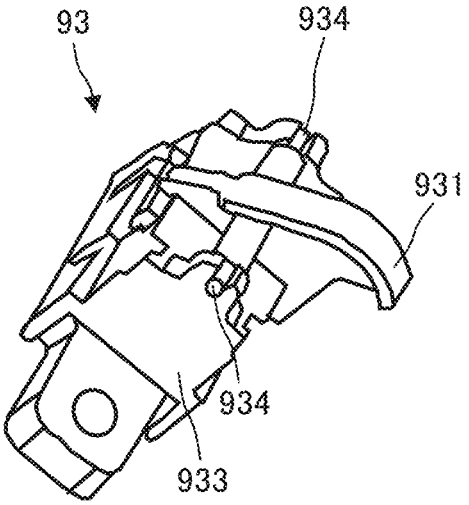
Figure 7C:
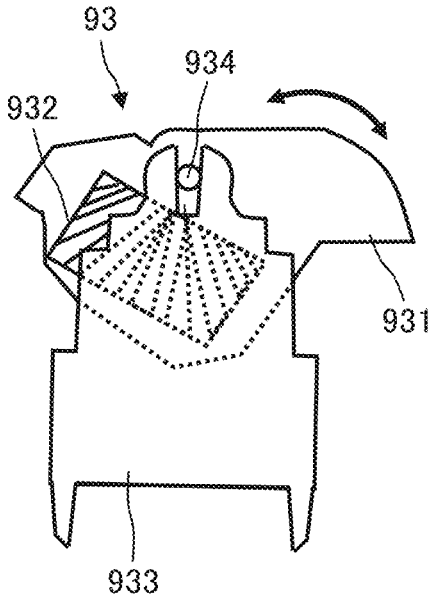

FIGS. 7A, 7B, and 7C are diagrams each illustrating a configuration example of the arm 91 according to an embodiment of the present disclosure. Specifically, FIG. 7A is a perspective view illustrating an example of the arm 91, FIG. 7B is a schematic diagram illustrating the external appearance of the sensor 93, and FIG. 7C is a side view illustrating an example of an actuator and a side plate, each included in the sensor 93.

In the operation in which the sensor 93 detects the leading end of the sheet roll (reverse rotation), the roller 92 is disposed on the upstream side of the arm 91 in the sheet conveyance direction and the sensor 93 is disposed on the downstream side of the arm 91 in the sheet conveyance direction. In other words, the sensor 93 is disposed downstream from the roller 92 in the sheet conveyance direction, i.e., the rotational direction of the sheet roll Pr.

The sensor 93 includes an encoder sensor that includes, for example, an actuator 931 and a slit 932 in the actuator 931. The actuator 931 is disposed between two side plates 933 that construct the sensor housing. A shaft 934 is fitted into a bearing of the side plates 933 and rotates about the shaft 934. The actuator 931 has an asymmetrical shape centered on the shaft 934, for example, as illustrated in FIG. 7C.

The sensor 93 has a light emitting portion and a light receiving portion. The number of lights passing from the light emitting portion to the light receiving portion through the slits 932 of the actuator 931 is counted, in other words, the number of signal waveforms are counted, so that the leading end of the sheet roll Pr is detected.

In the configuration example of FIGS. 7A, 7B, and 7C, there are two rollers 92 and the sensor 93 is disposed between the two rollers 92. By disposing the sensor 93 between the rollers 92, the lifting of the leading end of the sheet roll Pr is pressed reliably. By so doing, the output of the sensor 93 is not varied according to the state of the thickness, stiffness, and curling of the sheet, and therefore the leading end of the sheet is detected reliably. Further, since each roller 92 and the sensor 93 are disposed offset from each other in the circumferential direction of the sheet roll, even if there is a partial scratch, for example, it is less likely that the scratch is extended on both the roller 92 and the sensor 93. Therefore, it is difficult to generate misdetection of the leading end of the sheet P.

In the following description, two or more rollers 92, in other words, the plurality of rollers, are also referred to as roller portions.

Figure 8A:
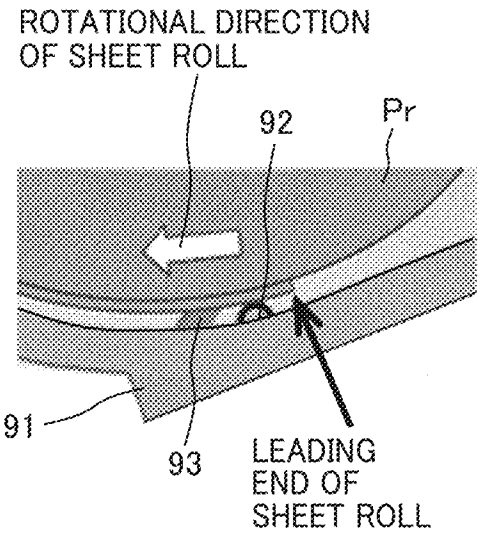
FIGS. 8A, 8B, and 8C are diagrams each illustrating an operation example of detecting the leading end of the sheet roll.
Figure 8B:
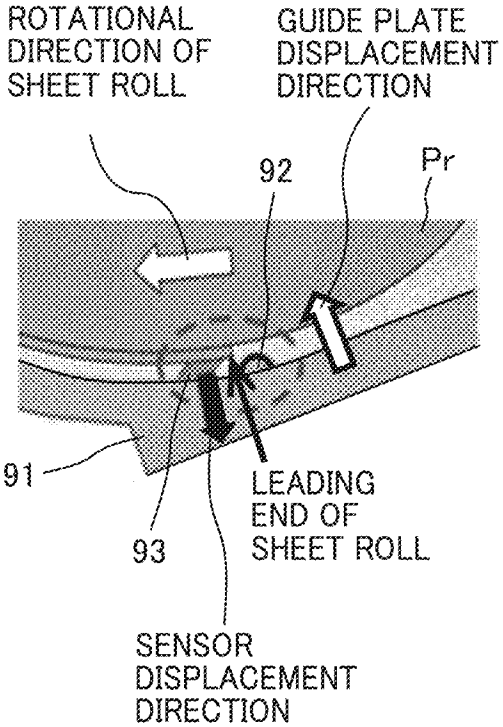
Figure 8C:
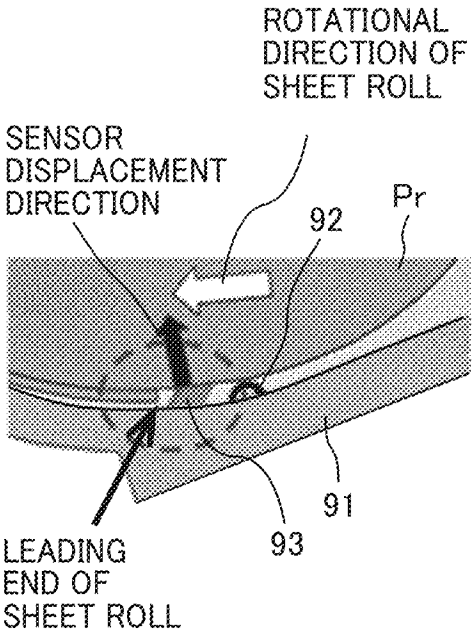
Figure 9B:
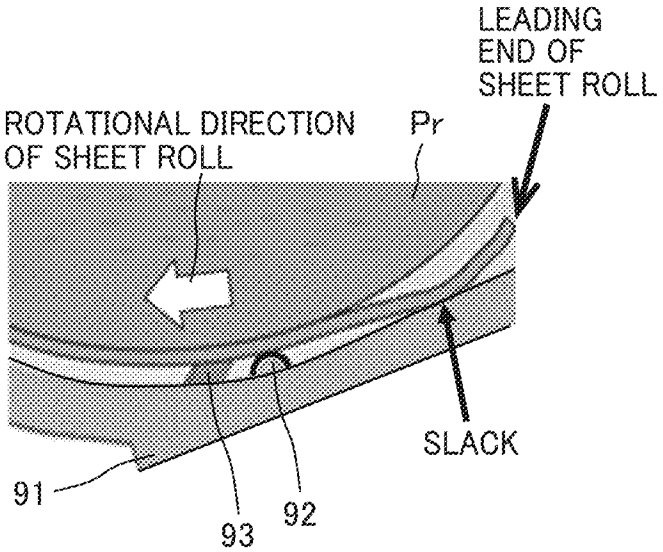
FIGS. 9A and 9B are diagrams each for explaining a difference in the position of a roller relative to a sensor.
Figure 9A:
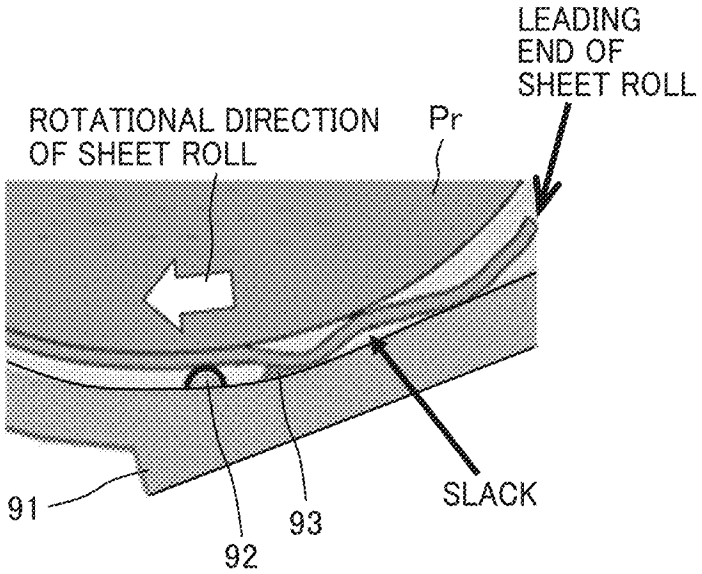

FIGS. 8A, 8B, and 8C are diagrams each illustrating an embodiment of an operation of detecting the leading end of the sheet roll Pr. FIGS. 9A and 9B are diagrams each for explaining a difference due to the position of the roller 92 relative to the sensor 93.

FIGS. 8A, 8B, and 8C illustrate states in which the leading end of the sheet roll Pr passes the roller 92 and the sensor 93. To be more specific, FIG. 8A is the state before the leading end of the sheet roll Pr passes the rollers 92, FIG. 8B is the state after the leading end of the sheet roll Pr has passed the rollers 92 and before the leading end of the sheet roll Pr passes the sensor 93, and FIG. 8C is the state after the leading end of the sheet roll Pr has passed the sensor 93.

FIGS. 9A and 9B illustrate states in the detection of the leading end of the sheet roll Pr to indicate the difference in occurrence of slack of the sheet roll Pr. To be more specific, FIG. 9A is the state in which the rollers 92 are disposed downstream from the sensor 93 in the sheet conveyance direction, and FIG. 9B is the state in which the rollers 92 are disposed upstream from the sensor 93 in the sheet conveyance direction.

The sensor 93 and the rollers 92 are disposed close to each other and offset from each other, in other words, disposed offset in the circumferential direction of the sheet roll Pr. According to this configuration, since the rollers 92 are disposed upstream from the sensor 93 in the sheet conveyance direction, the roller 92 presses the leading end of the roll sheet Pr immediately before the sensor 93 detects the leading end of the sheet roll Pr (FIG. 8A).

According to this configuration, while the tip end of the sensor 93 is in close contact with the surface of the sheet roll Pr, as illustrated in FIG. 9B, the sensor 93 detects the step (thickness) of the surface of the sheet roll Pr as the leading end of the sheet roll Pr. Accordingly, the output of the sensor 93 (i.e., the detection result of the sensor 93) is not varied according to the state of the thickness, stiffness, and curling of the sheet, and therefore the sensor 93 detects the leading end of the sheet roll Pr reliably.

Note that the roller 92 (or the rollers 92) is disposed upstream from the sensor 93 in the sheet conveyance direction in the example of the present embodiment but the leading end of the sheet roll Pr may be detected with a configuration in which the rollers 92 and the sensor 93 are disposed in the opposite positions, as illustrated in FIG. 9A. However, it is preferable that the roller 92 is disposed upstream from the sensor 93 so that the lifting of the leading end of the sheet roll Pr is pressed more reliably until immediately before the detection of the leading end of the sheet roll Pr.

Further, since two rollers 92 are provided and the sensor 93 is disposed between the rollers 92 as illustrated in FIG. 7, when compared to the configuration having one roller 92, the lifting of the leading end of the sheet roll Pr is pressed more reliably.

Figure 10A:
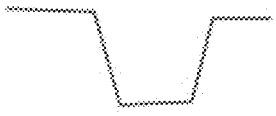
FIGS. 10A and 10B are diagrams each illustrating an example of a signal waveform detected by the sensor.
Figure 10B:
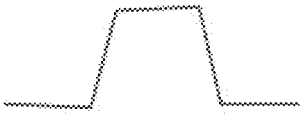

Further, since the sheet feeding device 90 according to an embodiment of the present disclosure has the configuration in which each roller 92 and the sensor 93 are disposed offset (shifted) from each other in the circumferential direction of the sheet roll Pr, even if there is a partial scratch, for example, it is less likely that the scratch is extended on both the roller 92 and the sensor 93. FIGS. 10A and 10B are diagrams each illustrating an example of a signal waveform detected by the sensor. To be more specific, FIG. 10A illustrates an example of a signal waveform when the leading end of the sheet roll is detected and FIG. 10B illustrates an example of a signal waveform when a projecting streak or scratch is detected.

In a case of the arrangement of the roller 92 and the sensor 93 as illustrated in FIG. 7, in a regular detection of the leading end of the sheet roll Pr (in a case in which the leading end of the sheet P passes), the signal waveform illustrated in FIG. 10A is formed.

On the other hand, when a strip-shaped projecting streak (scratch) is formed on the surface of the sheet roll Pr, the signal waveform illustrated in FIG. 10B has a rise and a fall different from the signal waveform of the detection of the leading end of the sheet roll Pr. Therefore, the controller 110 distinguishes the detection result of the sensor 93 between the signal waveform of the regular detection of the leading end of the sheet roll and the signal waveform of the detection of the scratch, so that the projecting streak (scratch) is rejected as a foreign material (is not the leading end of the sheet roll). Accordingly, detection of the leading end of the sheet roll and the projecting streak (scratch) is hardly performed with error.

Figure 11:
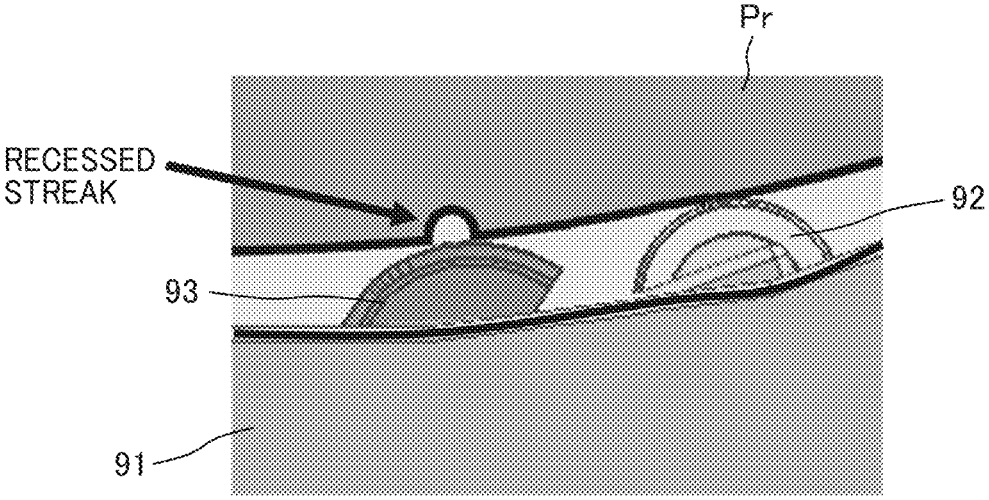
FIG. 11 is a diagram for explaining a case in which the sheet roll has a recessed streak or a concave scratch on the surface of the sheet roll.

Next, a description is given of detection of a recessed streak (concave-shaped scratch). FIG. 11 is a diagram for explaining a case in which the sheet roll has a recessed streak (scratch) on the surface of the sheet roll.

In a case of a recessed streak (scratch), the shape of the tip end of the sensor 93 is generally greater than the recessed streak (scratch) and the edge of the scratch does not have the acute angle as the angle of the leading end of the sheet roll. Therefore, the streak or scratch is not detected. By making the shape of the actuator greater than the recessed streak (scratch), the sensor 93 does not detect the recessed streak (scratch), and therefore the detection is not made with error. Accordingly, the detection accuracy is achieved.

According to the configuration illustrated in FIGS. 4 to 11, the leading end of the sheet roll is directly detected. Therefore, the output of the sensor 93 (detection result) does not vary according to the state of the thickness, stiffness, or curling of the sheet, and therefore the sensor 93 detects the leading end of the sheet roll Pr reliably with the detection accuracy. Further, with a simple operation that a user places the sheet roll placed on the sheet feeding device 90, the setting of the sheet roll is automatically finished. This configuration reduces the manual effort and prevents skew and paper jam caused by a guiding failure.

As described above, the configuration example of the sheet feeding device according to an embodiment of the present disclosure is explained. However, it is preferable that the sensor 93 is configured as described below.

Figure 12B:
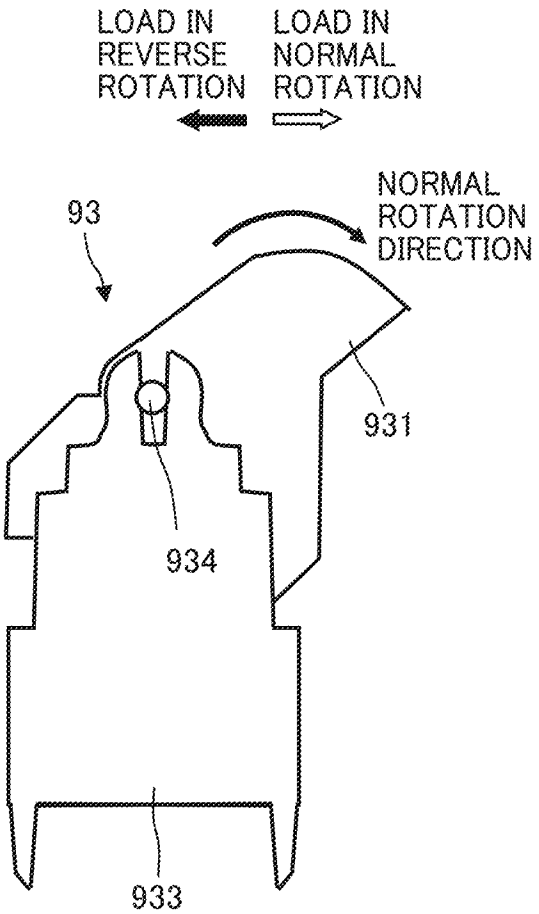
FIGS. 12A and 12B are diagrams each illustrating a frictional load applied to the surface of the sheet roll when an actuator of the sensor contacts the surface of the sheet roll.
Figure 12A:
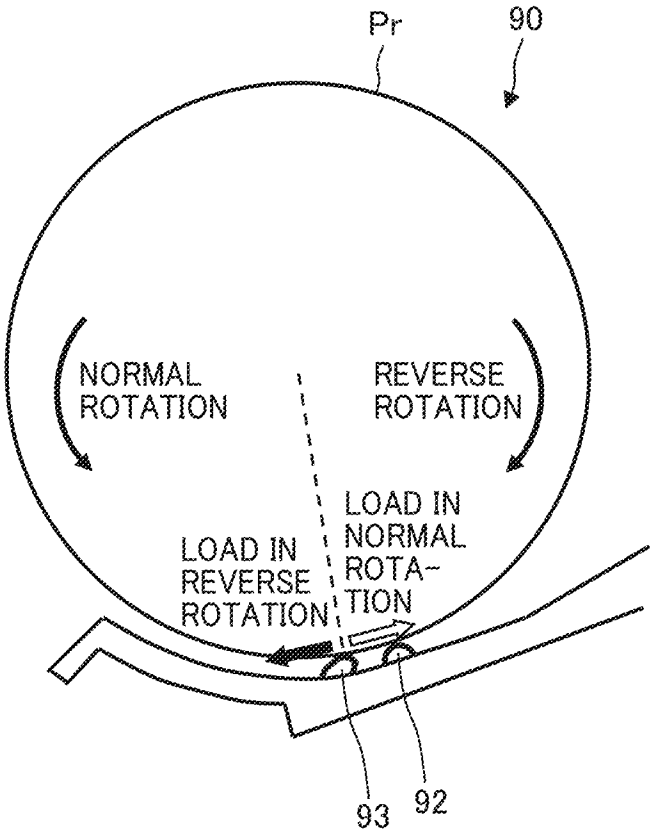

FIGS. 12A and 12B are diagrams each illustrating a frictional load applied to the surface of the sheet roll when the actuator of the sensor contacts the surface of the sheet roll. When the actuator 931 of the sensor 93 contacts the surface of the sheet roll, as the sheet roll rotates, the frictional load is generated on the contact portion.

The "normal" direction (normal rotation) illustrated in FIG. 12A indicates the rotational direction in the sheet feeding operation when the sheet roll Pr is conveyed in the sheet conveyance direction. The "reverse" direction (reverse rotation) illustrated in FIG. 12A indicates the rotational direction in the detection of the leading end of the sheet roll Pr.

In the "reverse rotation" direction, the "load at the reverse rotation" is generated to the actuator 931, so that a force is applied in a direction in which the actuator 931 bites the sheet roll Pr.

On the other hand, in the "normal rotation" direction, when the "load at the normal rotation" is generated to the actuator 931, the actuator 931 rotates about a shaft 934 as a rotation fulcrum to reduce the load. In other words, the actuator moves in a direction to reduce the load applied to the actuator when the load is generated to the actuator on the contact portion of the actuator and the sheet roll Pr as the sheet roll Pr rotates in the sheet feeding operation.

Here, the detection of the leading end of the sheet roll Pr in the "reverse rotation" direction is an operation when the sheet roll Pr is set to the sheet feeder of the sheet feeding device.

When compared with the rotational direction of the sheet roll Pr along with the operations (e.g., the sheet feeding operation and the printing operation) in the "normal rotation" direction, the "normal rotation" direction takes a substantially longer time to perform the operation. When the large force is applied to the actuator 931 in the "normal rotation" direction, it is more likely that the operation failure occurs due to damage of the sensor 93 and wear of the actuator 931. Therefore, the sheet feeding device has the configuration in which the load is avoided (eliminated) when the sheet roll is rotated in the "normal rotation" direction, so as to prevent the damage and operation failure.

Figure 13:
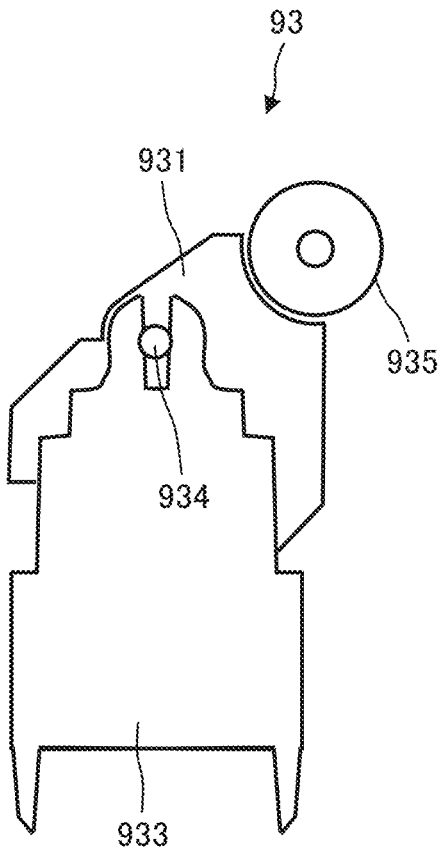
FIG. 13 is a diagram for explaining an example that the actuator has a tip end that contacts the sheet roll and that is provided with a rotatable roller.

FIG. 13 is a diagram for explaining an example that the actuator has a tip end that contacts the sheet roll and that is provided with a rotatable roller functioning as a rotary body.

Even when the actuator 931 of the sensor 93 has the frictional load with the sheet roll Pr, a roller 935 rotates to reduce the load to the actuator 931, thereby preventing damage and the operation failure.

Note that this configuration example describes the configuration in which the actuator rotates, but the configuration is not limited to this configuration example. For example, the configuration in which the actuator moves vertically and has the tip end provided with a rotatable roller may be applied to the present disclosure.

Next, a description is given of a variation of a support having the sensor and the roller.

Figure 14:
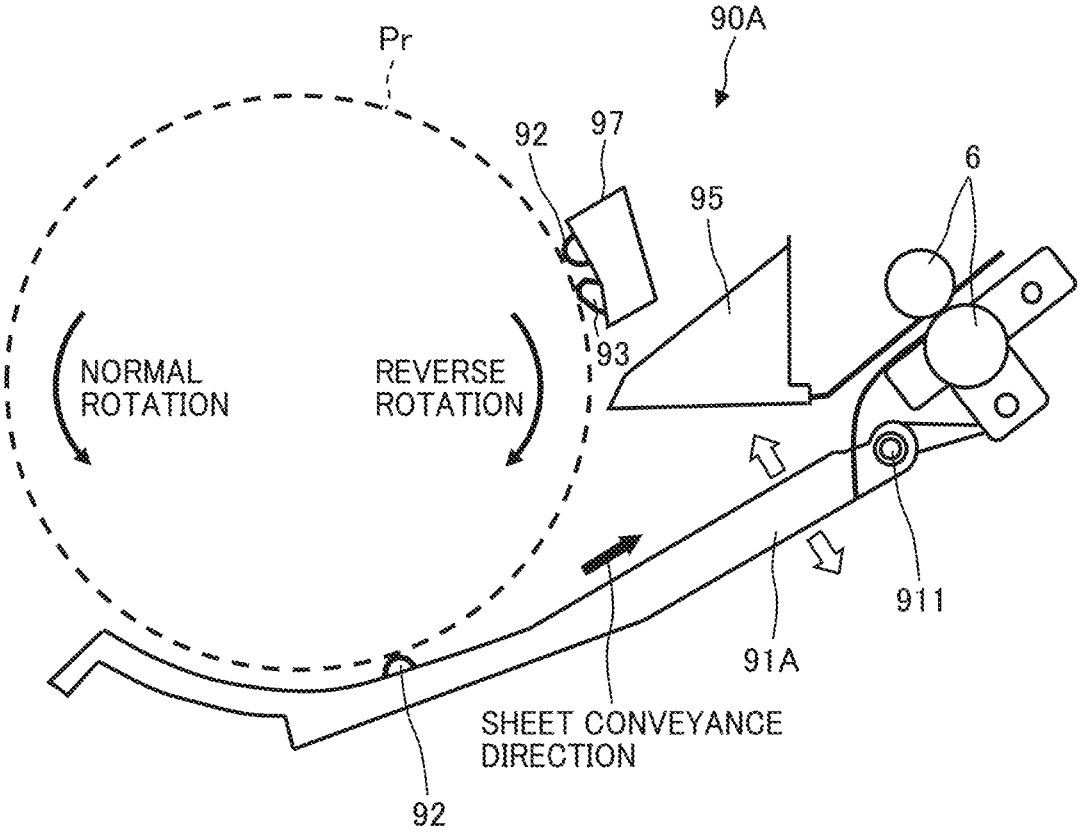
FIG. 14 is a diagram for explaining an example that a sensor and a roller are provided near an entrance guide plate for sheet conveyance.

While the configuration example illustrated in FIG. 4 includes the arm 91 that functions as a support, the configuration example illustrated in FIG. 14 includes another support that is different from the arm 91 (or the guide plate).

FIG. 14 is a diagram for explaining an example that the sensor 93 and the roller 92 are provided near the entrance guide plate 95 for sheet conveyance performed by a sheet feeding device 90A.

The sheet feeding device 90A basically has the configuration identical to the configuration of the sheet feeding device 90, except that the sheet feeding device 90A includes an arm 91A instead of the arm 91 of FIG. 4, and a support 97 that holds the sensor 93 and the roller 92 (or rollers 92). The support 97 is disposed near the entrance guide plate 95 and upstream from the entrance guide plate 95 in the "reverse rotation" direction, in other words, in the direction when the sheet roll Pr rotates in the reverse rotation operation. The arm 91A basically has the structure identical to the structure of the arm 91 illustrated in FIG. 4, except that the arm 91A does not include the sensor 93.

According to this configuration, immediately after the roller 92 (or the rollers 92) and the sensor 93, which are held by the support 97, have detected the leading end of the sheet roll Pr, the leading end of the sheet roll Pr is stopped at the position between the entrance guide plate 95 and the arm 91A, so that the leading end of the sheet roll Pr is fed to the pair of sheet conveying rollers 6 in the "normal rotation" operation. Accordingly, the normal rotation operation starts in the shortest time from the detection of the leading end of the sheet roll.

The support 97 is disposed to face toward the substantially center of the sheet roll Pr.

According to this configuration, even as the diameter of the sheet roll Pr changes, the support 97 is continuously in contact with the surface of the sheet roll Pr.

As described above, since the image forming apparatus that feeds the sheet in a roll shape includes the sheet feeding device according to an embodiment of the present disclosure, with a simple operation that a user sets the sheet roll to the image forming apparatus, the sheet thickness sensor such as the encoder sensor automatically detects the leading end of the sheet roll to convey the leading end of the sheet roll to the sheet feeder of the sheet feeding device. Accordingly, the manual effort taken for setting the sheet roll is omitted and the sheet is inserted into the sheet feeder reliably, and therefore the sheet is prevented from being inserted obliquely or at an angle, into the sheet feeder.

Further, since the sheet feeding device according to an embodiment of the present disclosure detects the leading end of the sheet roll while the leading end of the sheet roll is closely contact with the surface of the sheet roll, the leading end of the sheet roll is detect reliably regardless of the state of the thickness, stiffness, and curling of the sheet. Further, variation in manual insertion of the sheet is eliminated when setting the sheet roll, and therefore the leading end of the sheet roll is inserted into the sheet feeder reliably.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure.

The embodiments described above are not intended to limit the scope of the invention.

These novel embodiments can be implemented in various other forms, and various omissions, replacements, or changes can be made without departing from the gist of the invention.

These embodiments and their variations are included in the scope and gist of this disclosure and are included in the scope of the invention recited in the claims and its equivalent.

Any one of the above-described operations may be performed in various other ways, for example, in an order different from the one described above.

This patent application is based on and claims priority to Japanese Patent Application No. 2020-007309, filed on Jan. 21, 2020, in the Japan Patent Office, the entire disclosure of which is hereby incorporated by reference herein.

REFERENCE SIGNS LIST

6 Pair of sheet conveying rollers
90, 90A Sheet feeding device
91, 91A Arm
92 Roller
93 Sensor
95 Entrance guide plate
97 Support
100, 110 Controller
120, 140 Motor drive circuit
130 Sheet roll driver
150 Sheet conveyance driver
160 Sheet conveyor
911 Rotation center
931 Actuator
932 Slit
933 Side plate
934 Shaft

CITATION LIST

Patent Literature

[PTL 1]
JP-2018-150107-A

The invention claimed is:

1. A sheet feeding device configured to feed a sheet from a sheet roll, the sheet feeding device comprising:
a sensor;
a roller; and
a support on which the sensor and the roller are disposed,
the support supporting the sensor and the roller so that the sensor and the roller contact a surface of the sheet roll,
the sensor and the roller facing toward an axial center of the sheet roll,
the roller being spaced apart from the sensor in a circumferential direction of the sheet roll,
the sensor having a detection accuracy capable of detecting a step at a leading end of the sheet roll.

2. The sheet feeding device according to claim 1,
wherein the sensor is disposed downstream from the roller in a rotational direction of the sheet roll in an operation in which the sensor detects the leading end of the sheet roll.

3. The sheet feeding device according to claim 1,
wherein the sensor includes an encoder sensor.

4. The sheet feeding device according to claim 1,
wherein the support is a guide plate configured to guide the sheet fed from the sheet roll.

5. The sheet feeding device according to claim 1, further comprising an entrance guide plate configured to guide the sheet in a sheet conveyance direction,
wherein the support is disposed upstream from the entrance guide plate in a rotational direction of the sheet roll in a sheet feeding operation.

6. The sheet feeding device according to claim 1,
wherein the support includes two or more rollers including the roller, and wherein the sensor is disposed between the two or more rollers.

7. The sheet feeding device according to claim 1,
wherein the sensor includes:
side plates; and
an actuator rotatably disposed between the side plates,
wherein the actuator is configured to move in a direction to reduce a load to the actuator when the load is generated by contact of the actuator and the sheet roll as the sheet roll rotates in a sheet feeding operation.

8. The sheet feeding device according to claim 7,
wherein the actuator has a tip end provided with a rotary body.

9. An image forming apparatus comprising:
an image forming device configured to form an image on a sheet; and
the sheet feeding device according to claim 1.

* * * * *